US008326187B2

(12) United States Patent
Mano et al.

(10) Patent No.: US 8,326,187 B2
(45) Date of Patent: Dec. 4, 2012

(54) TONER CARTRIDGE AND IMAGE FORMING APPARATUS USING THE SAME

(75) Inventors: Ryosuke Mano, Osaka (JP); Hisashi Kunihiro, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 176 days.

(21) Appl. No.: 12/858,589

(22) Filed: Aug. 18, 2010

(65) Prior Publication Data

US 2011/0052268 A1 Mar. 3, 2011

(30) Foreign Application Priority Data

Sep. 3, 2009 (JP) ..... 2009-203934

(51) Int. Cl.
*G03G 15/08* (2006.01)

(52) U.S. Cl. ..... 399/262

(58) Field of Classification Search ..... 399/119, 399/120, 254, 255, 256, 257, 258, 262, 263
See application file for complete search history.

(56) References Cited

U.S. PATENT DOCUMENTS 5,629,759 A * 5/1997 Jyoroku ..... 399/262
7,693,463 B2 * 4/2010 Yoshida et al. ..... 399/258
2008/0095553 A1 * 4/2008 Tanaka et al. ..... 399/263
2008/0170899 A1 7/2008 Nojiri et al.
2009/0220285 A1 * 9/2009 Kimura et al. ..... 399/263

FOREIGN PATENT DOCUMENTS

JP 1-250975 A 10/1989
JP 4-121764 A 4/1992
JP 2000-214667 A 8/2000
JP 2001-092254 A 4/2001
JP 2008-164909 A 7/2008
JP 2008-197636 A 8/2008
JP 2009-63855 A 3/2009

* cited by examiner

*Primary Examiner* — Walter L Lindsay, Jr.
*Assistant Examiner* — Frederick Wenderoth
(74) *Attorney, Agent, or Firm* — Nixon & Vanderhye P.C.

(57) ABSTRACT

A toner cartridge includes a toner reservoir for storing toner and a toner conveyor portion. The toner conveyor portion includes a toner discharge port for discharging toner stored in the toner reservoir to the outside and a toner conveying member for conveying toner to the toner discharge port. The toner conveyor portion includes an airtight cover that encloses the upper part of the toner conveying member located over the toner discharge port, a communication opening arranged near the toner discharge port to connect between the toner conveyor portion and the toner reservoir and a pressure relieve valve that opens and closes the communication opening in accordance with the pressure of the toner in the space enclosed by the airtight cover.

11 Claims, 7 Drawing Sheets

TONER CARTRIDGE AND IMAGE FORMING APPARATUS USING THE SAME

This Nonprovisional application claims priority under 35 U.S.C. §119 (a) on Patent Application No. 2009-203934 filed in Japan on 3 Sep. 2009, the entire contents of which are hereby incorporated by reference.

BACKGROUND OF THE TECHNOLOGY (1) Field of the Technology

The present technology relates to a toner cartridge for use in image forming apparatuses such as laser beam printers, multifunctional machines and the like and an image forming apparatus using this cartridge, in particular relating to a replaceable toner cartridge for storing toner as well as relating to an image forming apparatus using the cartridge.

(2) Description of the Prior Art

Conventionally, image forming apparatuses using static electrophotography usually include the processing steps of charging, exposure, development, transfer, separation, cleaning, charge erasing, fixing and the like.

In the image forming apparatus thus configured, the process for image forming is achieved as follows. That is, the surface of a photoreceptor that is rotationally driven is uniformly electrified by a charging device (charging step). Then, the photoreceptor surface thus electrified is illuminated with a laser beam from an exposure device to form an electrostatic latent image (exposure step). Subsequently, the electrostatic latent image on the photoreceptor is developed by a developing device to form a toner image on the photoreceptor surface (developing step). The toner image on the photoreceptor is transferred to a transfer medium by a transfer device (transfer step), the toner image is then heated by a fixing device and fixed to the transfer medium (fixing and separation steps). On the other hand, the residual toner remaining on the photoreceptor drum surface after the transfer step is removed by a cleaning device and collected into a predetermined collecting portion (cleaning step). The photoreceptor surface after cleaning is cleared of residual charge by a charge erasing device to prepare for a next image forming operation (charge erasing step).

In the image forming apparatus of this kind, a Mono-component developer consisting of a toner only or a dual-component developer consisting of a toner and a carrier is usually used.

Since a mono-component developer does not use any carrier, there is no need to have an agitating mechanism for mixing toner and carrier uniformly. Hence the developing device has the advantage of a simple structure. However, there is a drawback that the amount of static charge on the toner is unlikely to be stable.

On the other hand, since a dual-component developer needs to have an agitating mechanism for mixing the toner and carrier uniformly, there is a drawback that the developing device is complex. However, since the developer presents stable toner charging performance and suitability to high-speed machines, it is often used for high-speed image forming apparatuses and color image forming apparatuses.

When the dual-component toner is used, the toner in the developer is consumed every time a developing operation is performed. To deal with this, a toner cartridge that supplies toner to the developing device in accordance with consumption of the toner is provided.

The toner cartridge stores toner therein and discharges the toner from a toner discharge port. There are a number of known mechanisms including a system that supplies toner to the developer by discharging toner by means of a screw auger (screw-like toner conveying member), a sponge roller or the like, a system that supplies toner to the developing device as the toner container itself rotates to discharge the toner, and other systems.

Of these mechanisms, the system using an auger screw is ready to control the amount of supplied toner, hence has the advantage that toner can be directly supplied to the developer without use of an intermediate hopper. On the other hand, the toner is prone to be compressed while being conveyed by rotation of the auger screw, and the compressed toner impedes rotation of the auger screw, posing a problem of the auger screw being stuck.

To deal with this problem, as one of the prior art there is a disclosure (see Patent Document 1: Japanese Patent Application Laid-open 2000-214667) in which the conveying spiral (helical blade) of a conveyor auger (screw-formed toner conveying member) is partly cut away so as to reduce the pressure of the toner being conveyed.

However, in the toner cartridge disclosed in Patent Document 1, when the toner conveying member is started to rotate with the toner that is low in fluidity after the toner cartridge has been left for long time, the toner cannot be smoothly discharged from the toner discharge port, but becomes compressed so that the clumping toner builds up around the toner discharge port, causing the problem that the toner conveying member becomes stuck (or referred to as 'locked' hereinbelow).

SUMMARY OF THE TECHNOLOGY

The present technology has been devised in view of the above conventional problems, it is therefore an object of the present technology to provide a toner cartridge that can prevent the toner conveying member from being locked by compressed clumping toner inside the toner cartridge so as to achieve stable toner supply, as well as to provide an image forming apparatus using the same toner cartridge.

The toner cartridge according to the present technology for solving the above problem and the image forming apparatus using this toner cartridge are configured as follows:

The first aspect of the present technology resides in a toner cartridge comprising: a toner reservoir for storing toner; and, a toner conveyor portion including a toner discharge port for discharging the toner from the toner reservoir to the outside and a toner conveying member for conveying the toner to the toner discharge port, and is characterized in that the toner conveyor portion includes: in the vicinity of the toner discharge port, an enclosing member that encloses the upper part of the toner conveying member located over the toner discharge port; a communication opening connecting between the toner conveyor portion and the toner reservoir; and, a pressure relieving portion (e.g., pressure relief valve) for opening and closing the communication opening in accordance with the pressure of the toner enclosed by the enclosing member.

The enclosing member may be configured so as to enclose the upper part of the toner conveying member with a tunnel-like structure, for example.

The pressure relieving portion may be given as a structure that moves in such a direction as to open the communication opening as the pressure of toner rises and moves in such a direction as to close the communication opening as the pressure of toner falls.

The second aspect of the present technology is characterized in that the toner conveying member includes: a rotary shaft; and a helical blade provided around the rotary shaft, and the end of the helical blade on the downstream side with respect to the toner conveying direction is formed up to the vicinity of the peripheral edge of the communication opening.

The third aspect of the present technology is characterized in that the toner conveying member includes a plate-like discharge rotor provided on a plane that passes through the axis of the rotary shaft, and the discharge rotor is arranged so as to oppose the toner discharge port.

The fourth aspect of the present technology is characterized in that the pressure relieving portion is formed of an elastically deformable sheet member, and the sheet member is arranged so as to be able to close the communication opening and so that the end on the upper side of the communication opening is fixed while the end on the lower side of the communication opening is set free.

The fifth aspect of the present technology resides in an image forming apparatus for forming an image with toner based on electrophotography, comprising: a photoreceptor drum for forming an electrostatic latent image on the surface thereof; a developing device for forming a toner image by supplying toner to the electrostatic latent image on the photoreceptor drum surface; a toner cartridge for supplying toner to the developing device by means of a toner supply assembly; a transfer device for transferring the toner image on the photoreceptor drum surface to a recording medium; and a fixing device for fixing the toner image on the recording medium, and is characterized in that the toner cartridge employs a toner cartridge that has any one of the above first to fourth aspects.

According to the first aspect of the present technology, when the toner in the toner conveyor portion lowers in fluidity and is about to be compressed, the pressure relieving portion is released so as to permit the toner to escape from the toner conveyor portion to the toner reservoir, whereby it is possible to prevent the toner conveying member from being locked, which would occur as a result of toner compression and clumping.

According to the second aspect of the present technology, the helical blade will not compress the toner around the communication opening, hence it is possible to avoid excessive increase of the toner pressure acting on pressure relieving portion as a result of the helical blade.

According to the third aspect of the present technology, since it is possible to move the toner around the rotary shaft by means of the discharge rotor, the toner pressure can be readily transferred to the pressure relieving portion provided for the communication opening. As a result, it is possible to smoothly open the communication opening when the pressure of toner increases.

According to the fourth aspect of the present technology, the lower side of the communication opening is opened greater than the upper side as the flexible sheet is flexed. As a result, the toner becomes ready to move from the toner conveyor portion to the toner reservoir through the communication opening.

According to the fifth aspect of the present technology, since it is possible to eliminate the risk of the toner around the toner discharge port through which toner inside the toner cartridge is discharged, being compressed by the pressure of the toner conveying member that conveys the toner, and hence prevent the toner conveying member from being locked due to toner solidification, it is possible to achieve a reliable toner supply operation and obtain stable image density over a long period of time.

DESCRIPTION OF THE PREFERRED EMBODIMENTS

The embodiment of the present technology will hereinafter be described in detail with reference to the accompanying drawings.

Figure 1:
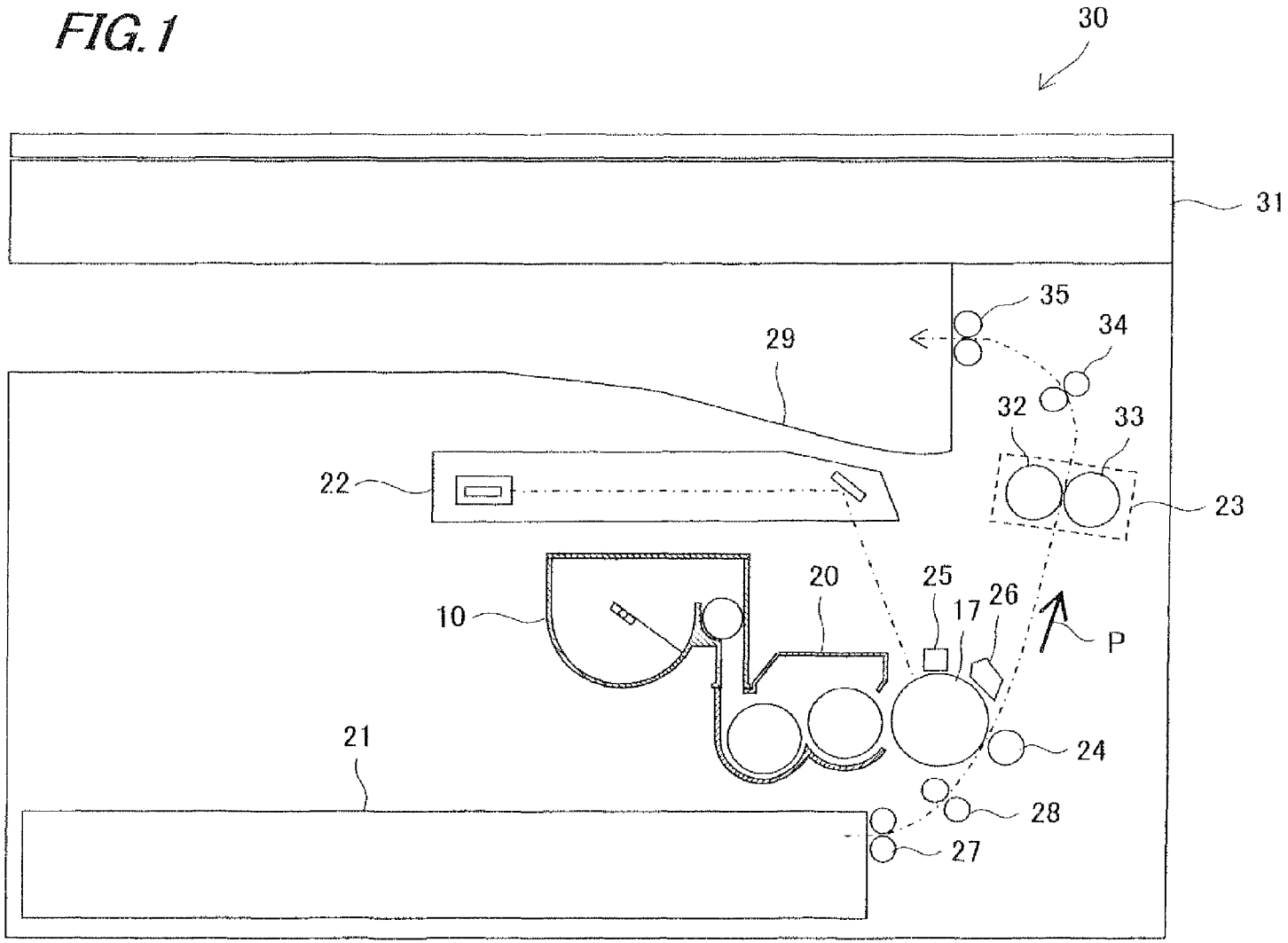
FIG. 1 is an illustrative view showing an overall configuration of an image forming apparatus in which a toner cartridge according to the embodiment of the present technology is used.

FIG. 1 is an illustrative view of one exemplary mode for carrying out the present technology, showing an overall configuration of an image forming apparatus using a toner cartridge according to the embodiment of the present technology.

An image forming apparatus 30 according to the present embodiment forms images with toner based on electrophotography, including: as shown in FIG. 1, a photoreceptor drum 17 on the surface of which an electrostatic latent image is formed; a developing device 20 that supplies toner to the electrostatic latent image on the photoreceptor drum 17 surface to form a toner image; a toner cartridge 10 that supplies toner to developing device 20 by way of a toner supply assembly; a transfer device 24 that transfers the toner image from the photoreceptor drum 17 surface to a recording medium; and a fixing unit 23 that fixes the transferred toner image to the recording medium.

Figure 2:
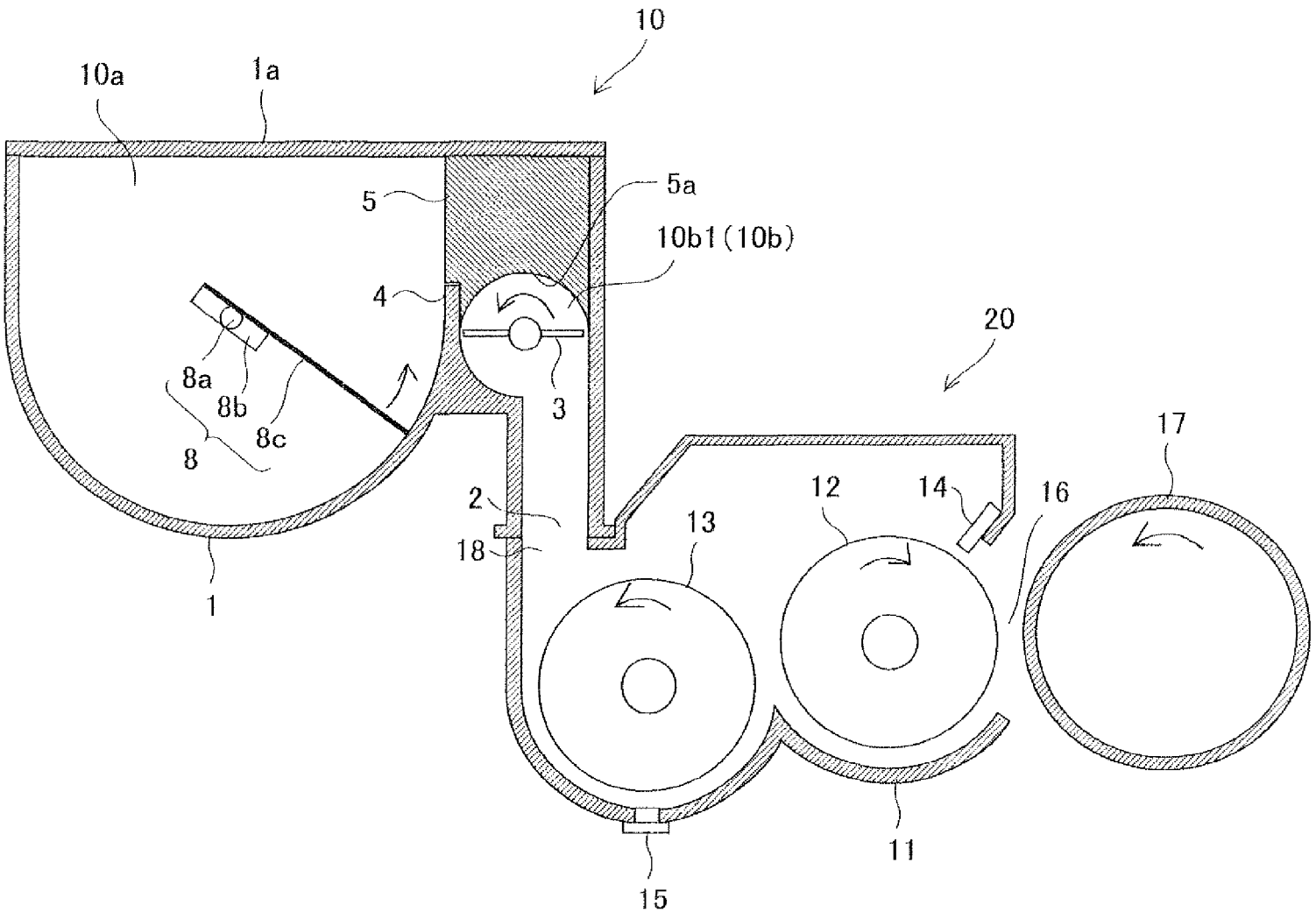
FIG. 2 is an illustrative view showing a configuration of a developing device according to the present embodiment.

As shown in FIG. 2, the toner cartridge 10 according to the present embodiment includes a toner conveying member 3 that discharges the toner in a toner container 1 to the outside of toner container 1 as it rotates and a toner agitator 8 for agitating toner inside toner container 1. This toner cartridge is configured so that it can be removably attached to developing device 20 mounted in image forming apparatus 30.

To begin with the overall configuration of image forming apparatus 30 will be described.

As shown in FIG. 1 image forming apparatus 30 of the present embodiment is, for example an electrophotographic multifunctional machine having copier, printer, facsimile and other functions, and includes toner cartridge 10, developing device 20, photoreceptor drum 17, a charger 25, an exposure device 22, a cleaning device 26, a transfer device 24, a fixing unit 23, a paper feed cassette 21, a pickup roller 27, a first conveying roller 28, a second conveying roller 34, a paper discharge roller 35, a paper output tray 29, a scanner unit 31 and a controller (not shown).

This image forming apparatus 30 forms monochrome or mono-color images on the recording mediums, in accordance with input image information.

Charger 25, developing device 20, transfer device 24 and cleaning device 26 are arranged around photoreceptor drum 17 along the rotational direction in the order mentioned.

Charger 25 is arranged above developing device 20 and cleaning device 26 with respect to the vertical direction.

Photoreceptor drum 17 is a roller-shaped member, which is axially supported and rotationally driven by a driver (not shown). This photoreceptor drum 17 includes, for example, a conductive base (not shown) and a photosensitive layer (not shown) formed on the conductive base surface.

Formed on the photosensitive layer surface is an electrostatic latent image and hence a toner image.

The conductive base may be formed of a conductive material such as aluminum, stainless steel or the like and given as a pipe-like, cylindrical or sheet-like configuration. Of these, a cylindrical configuration is preferable. As the photosensitive layer, for example, an organic photosensitive layer, an inorganic photosensitive layer or the like may be used. A photoreceptor drum including an organic photosensitive layer is called an organic photoreceptor drum, whereas a photoreceptor drum including an inorganic photosensitive layer is called an inorganic photoreceptor drum.

The organic photosensitive layer may be given as, for example, a lamination-type photosensitive layer in which a charge generating layer of a resin containing a charge generating substance and a charge transport layer of a resin containing a charge transport substance are laminated, or may be given as a mono-layered photosensitive layer including both a charge generating substance and a charge transport substance in a single resin layer.

The inorganic photoreceptor layer may be given as a mono-layered film containing one or two or more kinds of substances selected from, for example zinc oxide, selenium, amorphous silicon and the like. It is preferred that a primer coating is interposed between the conductive base and the photosensitive layer in order to overcoat the scratches and unevenness on the conductive base surface and smoothen the photosensitive layer surface. Also, a surface coating (protective coating) may be preferably formed on the photosensitive layer surface in order to protect the photosensitive layer and improve durability.

Charger 25 is connected to a power supply (not shown) and supplied with voltage from this power supply to electrify the photoreceptor drum 17 surface at a predetermined potential of a predetermined polarity. The charger 25 in the present embodiment uses a saw-toothed charger that implements corona discharge over photoreceptor drum 17. This saw-toothed charger is a non-contact type charger that is located facing photoreceptor drum 17 and spaced from the photoreceptor drum 17 surface.

Though in the present embodiment, the aforementioned saw-toothed charger is used as charger 25, the present technology is not limited to this. For example, non-contact type chargers including corona-discharge type chargers, and contact type chargers including roller-shaped chargers, charging brush type chargers and magnetic brush type chargers, and others may be used.

Exposure device 22 radiates light of signals in accordance with image information of a document scanned by scanner unit 31 or image information input from an external device, over the photoreceptor drum 17 surface that has been uniformly electrified at a certain potential by charger 25 so as to form an electrostatic latent image corresponding to the aforementioned image information on the photoreceptor surface. The exposure device 22 is arranged such that the emitted light of signals passes through and between charger 25 and developing device 20 to reach the photoreceptor drum 17 surface. As the exposure device 22, a laser scanning system including a light source may be used.

Examples of the laser scanning system include a system that uses a light source, a polygon mirror, an f-θ lens, reflection mirrors and others in combination, or a system that uses a liquid crystal shutter, a light source and others in combination. As the light source, a semiconductor laser, LED array, electroluminescence (EL) device and the like can be used.

Developing device 20 supplies toner to the electrostatic latent image formed on the photoreceptor drum 17 surface by means of exposure device 22 to form a toner image. Attached on top of developing device 20 is a removable toner cartridge 10 for supplying toner into developing device 20.

Cleaning device 26 removes toner, paper and other particles remaining on the surface of photoreceptor drum 17 after the toner image has been transferred to the recording medium to clean the photoreceptor drum 17 surface.

Cleaning device 26 includes an unillustrated cleaning blade and an unillustrated toner storing receptacle.

The cleaning blade is a plate-like member that extends parallel to the axial direction of photoreceptor drum 17 and is arranged so as to abut its longitudinal edge against the photoreceptor drum 17 surface. This cleaning blade abuts the surface of rotating photoreceptor drum 17 so as to remove toner, paper and other particles that remain on the photoreceptor drum 17 surface after transfer of the toner image to the recording medium, from the photoreceptor drum 17 surface.

The toner storing receptacle is a container-like member having a hollow space therein and temporarily holds the toner removed off by the cleaning blade and collects the toner.

The photoreceptor drum 17 surface uniformly electrified by charger 25 is illuminated with light of signals corresponding to image information by means of exposure unit 22 so as to form an electrostatic latent image. Then this electrostatic latent image is supplied with toner from developing device 20 to form a toner image. This toner image is transferred to the recording medium by the transfer device 24 described later while the toner remaining on the photoreceptor drum 17 surface after transfer of the toner image is removed by cleaning device 26.

Transfer device 24 is a roller-shaped member that is rotatably supported by an unillustrated supporting structure about its axis and arranged in press-contact with photoreceptor drum 17 so as to be rotationally driven by an unillustrated driver.

Transfer device 24 is formed of a metal core and an elastic conductive layer formed on the surface of the metal core (none of these are shown). The metal core is a pipe-like or cylindrical member, made of stainless steel, aluminum or other metal and having a diameter of 8 to 10 mm. The elastic conductive layer is formed of rubber material, such as ethylene-propylene rubber (which will be referred to hereinbelow as "EPDM"), foamed EPDM, foamed urethane, etc., in which conductive substances such as carbon black etc. are blended.

Transfer device 24 is connected to a power supply (not shown) and supplied from this power supply with voltage (which will be referred to hereinbelow as "transfer bias") of a polarity that is opposite to the polarity of the static charge on the toner forming the toner image on the photoreceptor drum 17 surface to thereby transfer the toner image from the photoreceptor drum 17 surface to the recording medium.

With this arrangement of transfer device 24, when the recording medium fed from aftermentioned paper feed cassette 21 passes through the pressure-contact portion (which will be referred to hereinbelow as "transfer nip portion") between photoreceptor drum 17 and transfer device 24, the toner image carried on the photoreceptor drum 17 surface is transferred to the recording medium under the application of the aforementioned transfer bias. The recording medium with the toner image transferred thereon is conveyed to fixing unit 23.

Fixing unit 23 is arranged downstream of transfer device 24 with respect to the direction in which recording mediums are conveyed, and includes a fixing roller 32 and a pressing roller 33. Fixing roller 32 is a roller-shaped member that is rotatably supported by a supporting structure (not shown) and can be axially rotated by a driver (not shown).

This fixing roller 32 is comprised of a metal core and an elastic layer (none of these are shown). The metal core is a cylindrical member made of metal such as iron, stainless steel, aluminum or the like. The elastic layer is formed of a mono-layered film of an elastic material such as silicone rubber, fluoro-rubber or the like and coated on the surface of the metal core.

Further, fixing roller 23 has a heating element (not shown) therein. This heating element is connected to a power supply (not shown) and supplied with voltage from this power supply so as to heat fixing roller 32 and keep the surface of the fixing roller 23 at a predetermined temperature. As the heating element, a halogen lamp, infrared lamp or the like can be used, for example. The fixing roller 32 heats and fuses the toner of the toner image on the recording medium that is delivered from the transfer nip portion, and fixes the toner image to the recording medium.

Pressing roller 33 is a roller-shaped member that is rotatably supported by a supporting structure (not shown) and pressed against fixing roller 32 by a pressing member (not shown). This pressing roller 33 is driven to rotate following the rotation of fixing roller 32. The pressing roller 33 may use the same configuration with that of fixing roller 32. It is also preferred that pressing roller 33 has a heating element (not shown) therein. This heating element may use the same configuration as that incorporated in fixing roller 32.

Pressing roller 33 assists the fixing of the toner image to the recording medium by pressing the fused toner to the recording medium when the toner is heated and fused to be fixed to the recording medium by fixing roller 32. The press-contact portion between fixing roller 32 and pressing roller 33 will be called "fixing nip portion" hereinbelow.

With this arrangement of fixing device 23, when the recording medium with a toner image transferred thereon by transfer device 24 passes through the fixing nip portion, the toner that forms the toner image is heated and fused, and pressed against the recording medium, whereby the toner image is fixed to the recording medium to complete an image.

Paper feed cassette 21 is a container member that is arranged at the bottom of image forming apparatus 30 with respect to the vertical direction to hold recording mediums. As the recording mediums, plain paper, coated paper, color copy paper, over head projector (OHP) sheets and the like may be used.

A pair of roller elements are arranged as pickup rollers so as to press each other. The pickup rollers pick up recording mediums one sheet at a time from the stack of sheets on paper feed cassettes 21 and delivers the sheet toward first conveying rollers 28, in synchronization with conveyance of the toner image on the photoreceptor drum 17 surface to the transfer nip portion as photoreceptor drum 17 rotates.

The first conveying rollers 28 are a pair of roller elements pressing each other, and conveys the recording medium fed from pickup roller 27 to the transfer nip portion. The second conveying rollers 34 are a pair of roller elements pressing each other, and arranged downstream of the fixing nip portion with respect to the recording medium conveying direction P to convey the recording medium with an image formed thereon by fixing unit 23, toward paper discharge rollers 35.

Paper discharge rollers 35 are a pair of roller elements pressing each other and discharges the recording medium conveyed from second conveying rollers 34 to paper output tray 29 arranged in the vertically upper part of image forming apparatus 30. Paper discharge tray 29 receives the recording medium with an image formed thereon by fixing unit 23, conveyed by second conveying rollers 34 and paper discharge rollers 35 and stacks the medium thereon.

Scanner unit 31 includes a document set tray, a reversing automatic document feeder (which will be referred to hereinbelow as "RADF") and an image reading device (none of these are shown).

The RADF feeds documents set on the document set tray to the document set table of the document reading device described hereinbelow. The document reading device includes the document set table, a document scanner, reflecting components and a line sensor of a photoelectric transducer (charge coupled device, which will be referred to hereinbelow as 'CCD') (none of these are shown).

The document set table is formed of a glass plate having a document set surface on which an original is placed to read image information therefrom. Mounted on the document set table is an airtight cover that is supported in an openable and closable manner relative to the document set table and includes the document set tray and the RADF. Documents to be set on the document set tray may be manually set by the user or set by means of RADF.

The document scanner is arranged so as to move in a reciprocating manner at a constant scanning speed V, parallel to, keeping a fixed distance from, the underside of the document set table. The document scanner includes a light source and a first reflecting mirror (none of these are illustrated).

The light source emits light over the image surface of a document placed on the document set table.

The first reflecting mirror reflects the reflected light image from the document to a reflecting assembly.

The document scanner moves parallel to the underside of the document set table at a constant scanning speed V in a reciprocating manner, and receives irradiation of light reflected from the image surface of the document placed on the document set table and emits the reflected light image toward the reflecting assembly.

The reflecting assembly is arranged so as to move in a reciprocating manner, parallel to the document scanner, keeping a fixed speed relationship with the document scanner, specifically at half the speed (V/2) of the speed of the document scanner. This reflecting assembly includes a second reflecting mirror, a third reflecting mirror and optical lenses (none of these are shown).

The second and third reflecting mirrors further reflect the reflected light image from the document and reflected off the first reflecting mirror of the document scanner, toward the optical lens. The optical lens reduces the reflected light image reflected off the second and third reflecting mirrors in size and focuses the reduced reflected light image onto the predetermined position on the CCD line sensor. The reflecting assembly reciprocates at a speed of V/2 following the reciprocating movement of the document scanner so as to focus the reflected light image reflected by the document scanner onto the predetermined position on the CCD line sensor.

The CCD line sensor includes a CCD circuit that photoelectrically converts the reflected light image focused by the optical lens into electric signals. The CCD line sensor picks up the image of the document and photoelectrically converts the picked up image information sequentially into electric signals and outputs the electric signals to the controller of image forming apparatus 30.

The scanner unit 31 having the above configuration reads the image information from the document set on the document set table, every multiple lines, for example, every ten lines, and converts the scanned image information into electric signals and outputs the signals to the controller of image forming apparatus 30.

The controller is disposed in the top part of image forming apparatus 30, and includes a processing circuit realized by a microcomputer or microprocessor including a CPU (Central Processing Unit), storage including ROM (Read Only Memory), RAM (Random Access memory) and HDD (Hard Disk Drive) and main power supply (none of these are shown).

The storage stores various kinds of set values input through a control panel (not shown) provided on the top of image forming apparatus 30, detected results from various sensors (not shown) arranged at different sites inside image forming apparatus 30, image information input from external devices, image information input from scanner unit 31 and various programs for executing various tasks such as printing jobs etc., and other necessary information.

As the external devices, electric and electronic devices that can form or acquire image information and can be electrically connected to image forming apparatus 30, can be used. Examples include a personal computer, digital camera, television receiver set, video recorder, DVD (Digital Versatile Disc) recorder, HDDVD (trade name: High Definition Digital Versatile Disc), blue-ray disk recorder, facsimile machine, mobile terminal and the like.

The processing circuit reads out various kinds of data such as detected results, image information, etc. and various kinds of programs, from the storage and performs various decisions and transmits control signals to the associated functional components inside the image forming apparatus 30 in accordance with the decision results, to thereby perform operation control of individual functional components.

For example, the processing circuit converts the image information input from scanner unit 31 or an external device into control signals and outputs the signals to exposure device 22. Alternatively, the processing circuit determines whether toner needs to be supplied, based on the detected result from an aftermentioned toner concentration detecting sensor 15, and transmits control signals to the drivers for rotationally driving toner conveying member 3 and toner agitator 8 of toner cartridges 10 if toner supply is determined to be necessary, to thereby rotationally drive toner conveying member 3 and toner agitator 8. The main power supply not only supplies power to the controller but also supplies power to each functional component inside image forming apparatus 30.

Next, developing device 20 according to the present embodiment will be described with reference to the drawings.

FIG. 2 is an illustrative view showing the configuration of the developing device according to the present embodiment.

As shown in FIG. 2, developing device 20 includes a developing vessel 11, an agitating roller 13, a developing roller 12, a regulating member 14 and a toner concentration detecting sensor 15.

Developing vessel 11 is a container-like member that has an approximately prism-like configuration having a hollow space therein and is arranged opposing the photoreceptor drum 17 surface. An opening 16 is formed on one side of developer vessel 11 that opposes photoreceptor drum 17. Developing roller 12 is placed at the position opposing photoreceptor drum 17 through this opening 16.

Developing vessel 11 stores a dual-component developer made of a toner and a carrier (which will be hereinbelow referred to simply as "developer") and incorporates and rotatably supports agitating roller 13 and a developing roller 12.

Formed in the upper part of developing vessel 11 with respect to the vertical direction is a toner input port 18 to be connected with toner discharge port 2 of toner cartridge 10. Toner is supplied from toner cartridge 10 to developing vessel 11 through this toner input port 18, in accordance with the state of toner consumption in developing vessel 11.

Agitating roller 13 is a roller-shaped member that is axially supported and rotationally driven by a driver (not shown) and arranged so as to oppose developing roller 12. Agitating roller 13 agitates the developer stored in developing vessel 11 and supplies the developer toward and around developing roller 12.

Developing roller 12 is a roller-shaped member that is rotationally driven about its axis by a driver (not shown) and arranged opposing photoreceptor drum 17 through opening 16 of developing vessel 11 with a predetermined gap apart from the photoreceptor drum.

Developing roller 12 is connected to a power supply (not shown) so that the developing roller 12 surface is applied with a potential that is opposite to the polarity of the static potential on the toner, as a developing bias voltage (which will be referred to hereinbelow as "developing bias"). With this application of the developing bias, the toner on the developing roller 12 surface is smoothly supplied to the electrostatic latent image on the photoreceptor drum 17 surface.

The developer conveyed by rotation of developing roller 12 comes into contact with photoreceptor drum 17 in the area where the roller surface and the drum surface become closest (which will be referred to hereinbelow as "developing nip portion"). In the developing nip portion, toner is supplied from the developer on the developing roller 12 surface to the electrostatic latent image on the photoreceptor drum 17 surface under application of the developing bias. As the level of the developing bias is varied, the amount of toner supplied to the electrostatic latent image (the amount of toner adherence) can be controlled.

Regulating member 14 is a plate-like member that is arranged vertically above developing roller 12 and extends parallel to the axial direction of developing roller 12. One long side of regulating member 14 is supported by developing vessel 11 while the other long side of the regulating member 14 is positioned opposing, a gap apart from, the developing roller 12 surface. Regulating member 14 may be formed of stainless steel, aluminum, synthetic resin or the like. Regulating member 14 regulates the layer thickness of the developer carried and conveyed by the surface of developing roller 12.

Toner concentration detecting sensor 15 is attached to the developer vessel wall vertically under agitating roller 13, or at the bottom surface of developing vessel 11 so that its sensor face is exposed to the interior space of developing vessel 11. Toner concentration detecting sensor 15 is electrically connected to a controller that is equipped in image forming apparatus 30.

Toner concentration detecting sensor 15 may use a general detection sensor. Examples include transmitted light detecting sensors, reflected light detecting sensors, magnetic permeability detecting sensors, etc. Of these, magnetic permeability detecting sensors are preferable because a sensor of this type receives application of control voltage and outputs the detection result of toner concentration as an output voltage value. Magnetic permeability detecting sensors of this kind are found on the market, examples including TS-L, TS-A and TS-K (all of these are trade names of products of TDK Corporation).

Toner concentration detecting sensor 15 is connected to a power supply (not shown). This poser supply applies to toner concentration detecting sensor 15 a drive voltage for driving toner concentration detecting sensor 15 and a control voltage for outputting the detected result of toner concentration to the controller of image forming apparatus 30. Application of voltage from the power supply to toner concentration detecting sensor 15 is controlled by the controller of image forming apparatus 30. In this connection, when a magnetic permeability sensor is used for toner concentration detecting sensor 15, because basically the sensor of this kind is highly sensitive in the middle range of an output voltage, it is preferable that the applied control voltage is adjusted so as to produce the output voltage around the mid point of the output voltage range.

Next, the features of toner cartridge 10 of the present embodiment will be described in detail with reference to the drawings.

Figure 3:
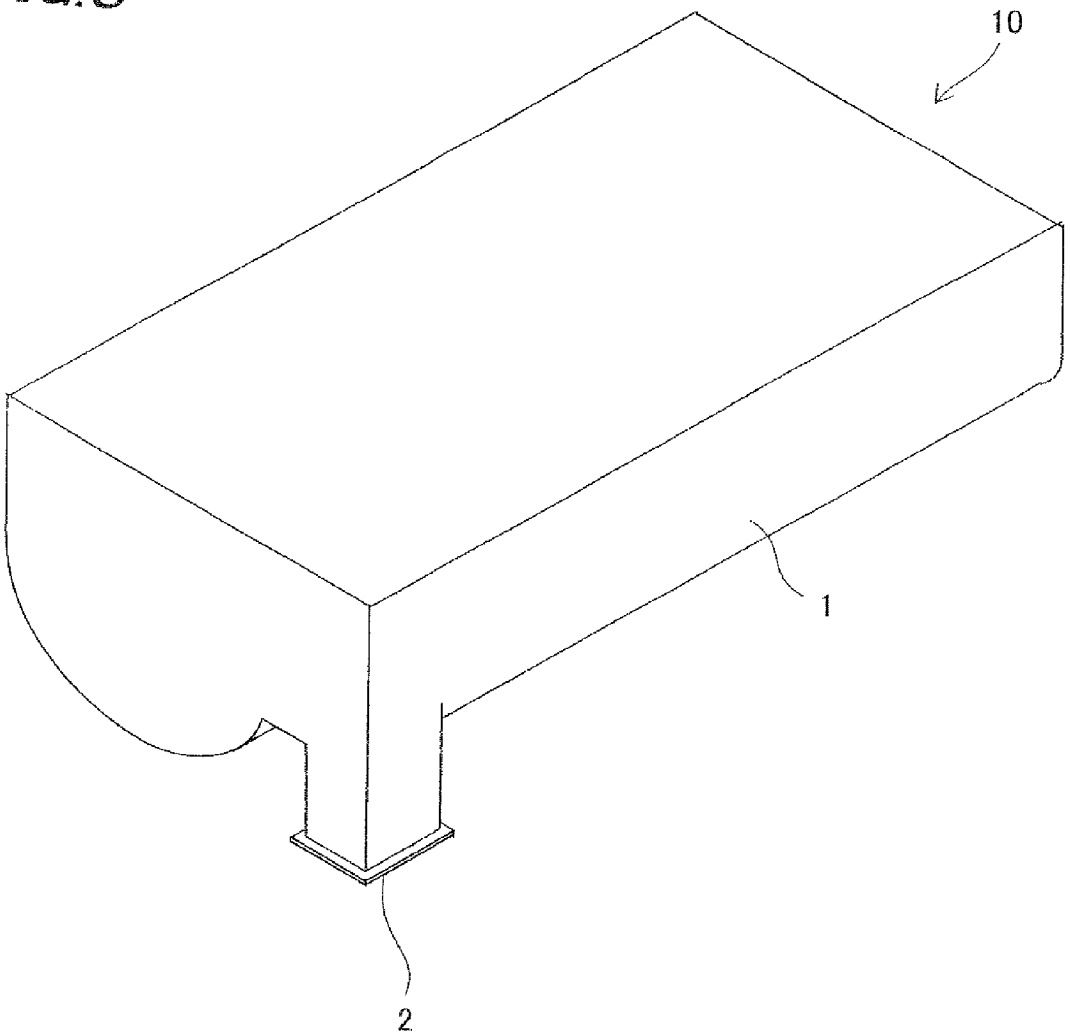
FIG. 3 is a perspective view showing an overall configuration of the toner cartridge.
Figure 4:
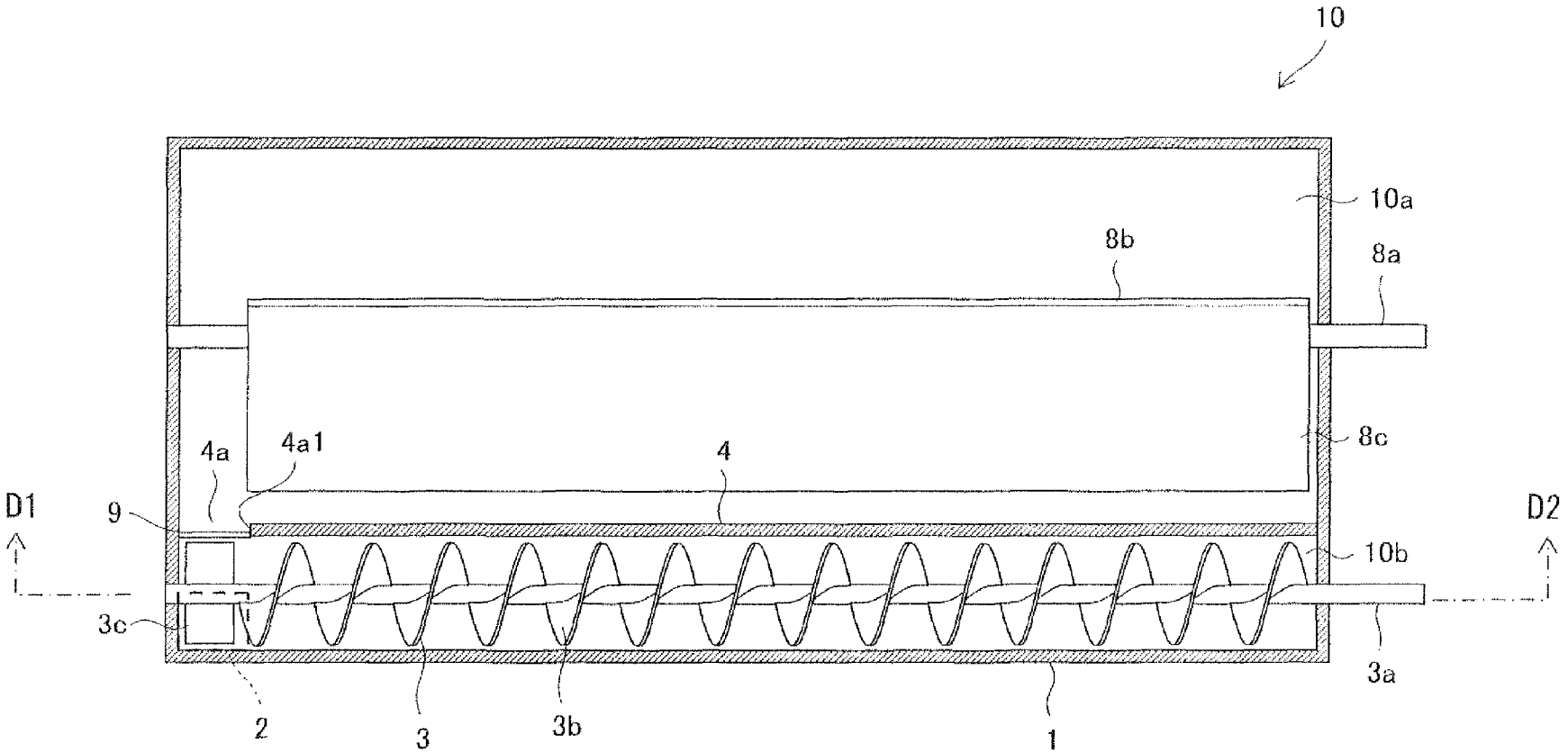
FIG. 4 is an illustrative view of the configuration of the toner cartridge, showing the interior of the toner container from top.
Figure 5:
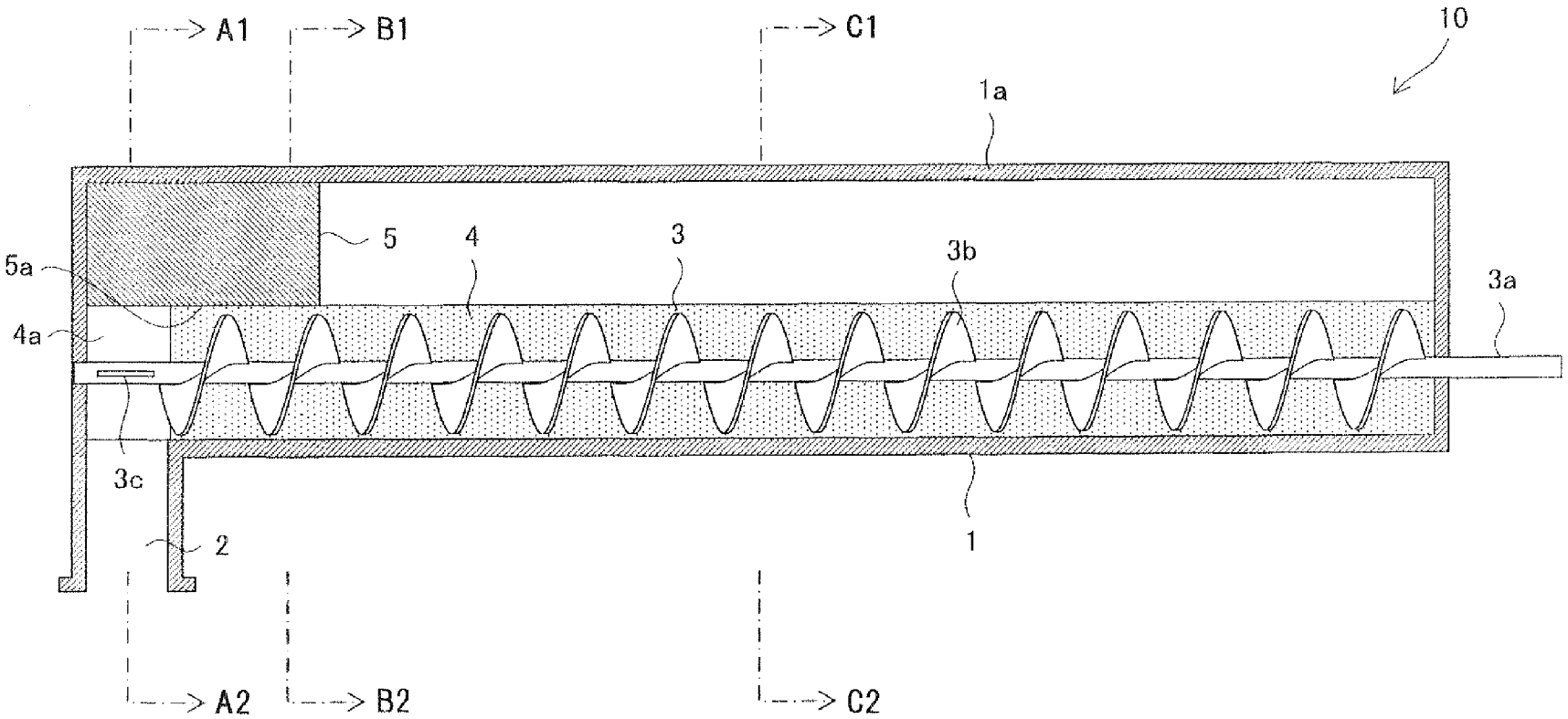
FIG. 5 is a sectional view cut along a plane D1-D2 in FIG. 4.
Figure 6A:
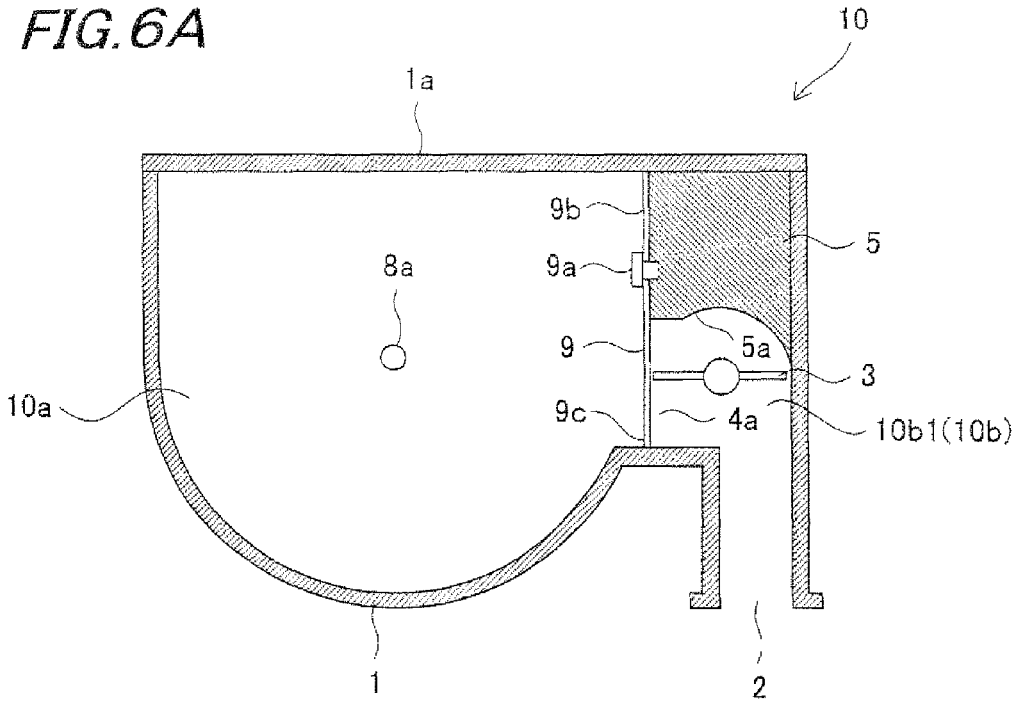
FIG. 6A is a sectional view cut along a plane A1-A2 in FIG. 5.
Figure 6B:
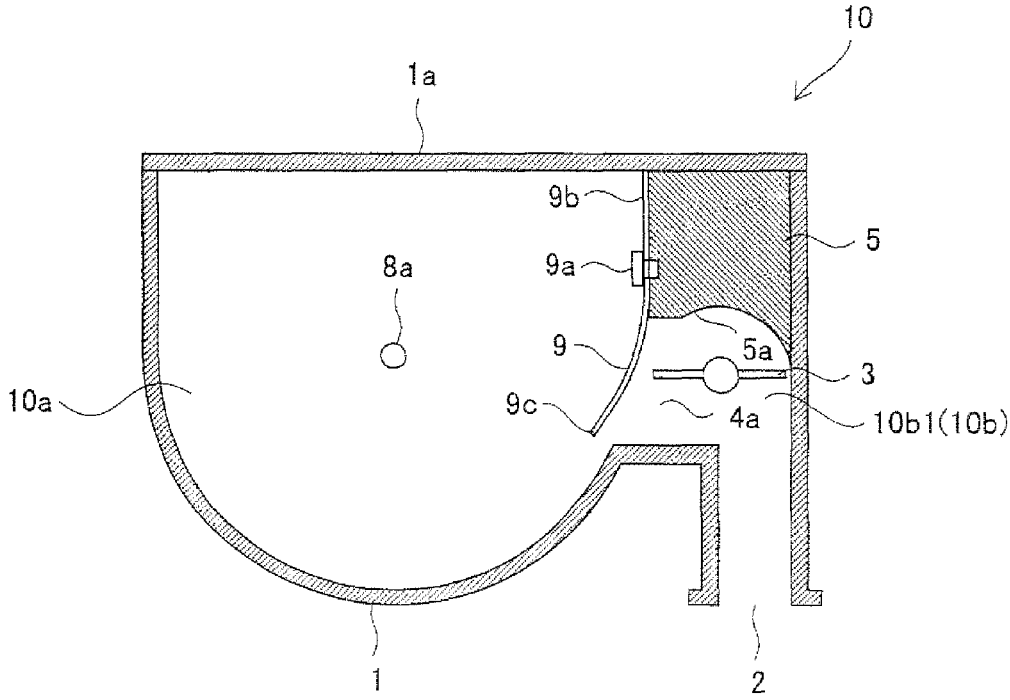
FIG. 6B is an illustrative view showing a state where a pressure relief-valve in FIG. 6A is operated.
Figure 7:
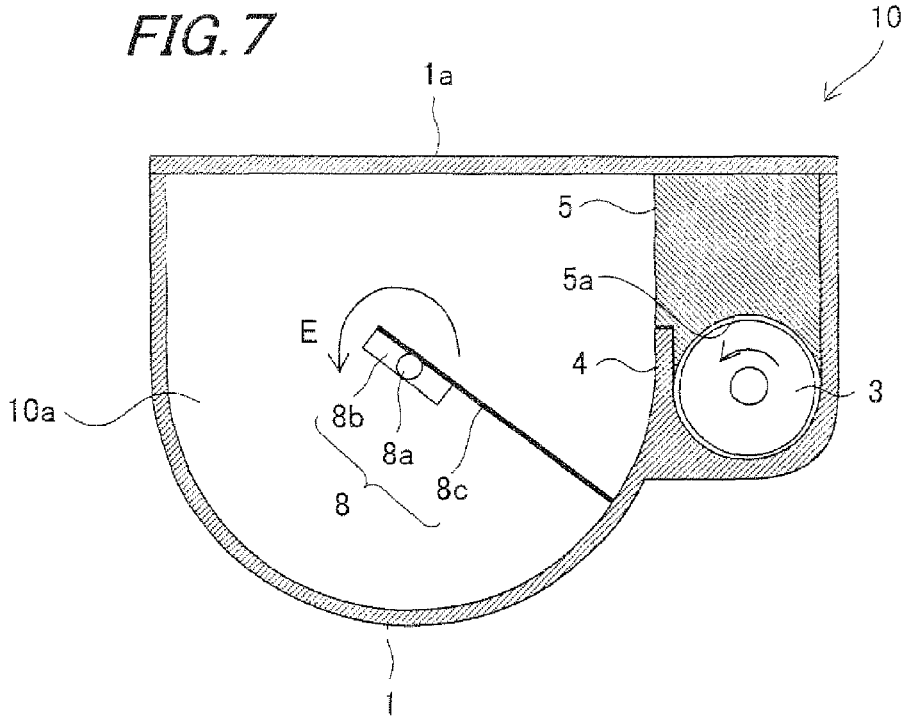
FIG. 7 is a sectional view cut along a plane B1-B2 in FIG. 5; and, FIG. 8 is a sectional view cut along a plane C1-C2 in FIG. 5.
Figure 8:
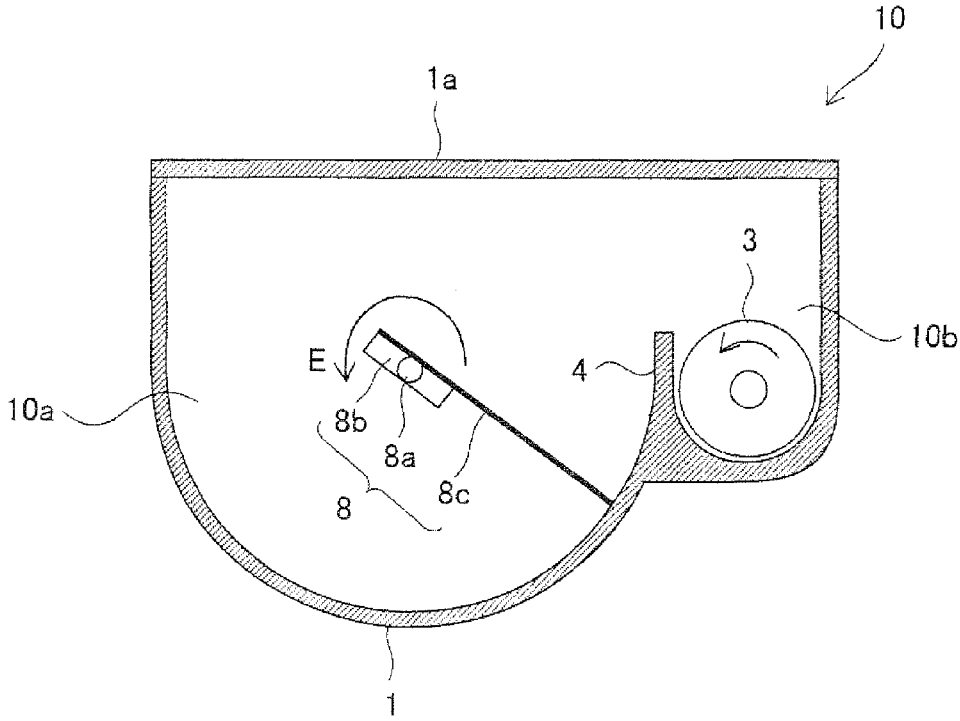

FIG. 3 is a perspective view showing an overall configuration of the toner cartridge according to the present embodiment. FIG. 4 is an illustrative view of the configuration of the toner cartridge, showing the interior of the toner container from top. FIG. 5 is a sectional view cut along a plane D1-D2 in FIG. 4. FIG. 6A is a sectional view cut along a plane A1-A2 in FIG. 5. FIG. 6B is an illustrative view showing a state where a pressure relief valve in FIG. 6A is operated. FIG. 7 is a sectional view cut along a plane B1-B2 in FIG. 5. FIG. 8 is a sectional view cut along a plane C1-C2 in FIG. 5.

As shown in FIGS. 2 to 6, toner cartridge 10 includes toner container 1, toner conveying member 3, toner agitator 8, an airtight cover (enclosing member) 5 and a pressure relief valve (pressure relieving portion) 9.

As shown in FIG. 2, toner container 1 is a receptacle having a bottom with an open top, and has an approximately semi-cylindrical configuration with an interior space for holding toner therein. The top of the container is hermetically closed by an upper lid 1*a*.

Further, as shown in FIGS. 2, 3 and 4, an approximately rectangular toner discharge port 2 as an opening for discharging toner is formed at one longitudinal end in the bottom of the toner container 1. This toner discharge port 2 is formed at such a position as to be connected to toner input port 18 that is provided on the top part of developing vessel 11. With this arrangement, toner is supplied from toner cartridge 10 into developing vessel 11 through this toner discharge port 2 in accordance with the state of toner consumption inside developing vessel 11.

Further, provided in the bottom of toner container 1 is a partitioning wall 4 which separates the interior space of toner container 1 into a toner reservoir 10*a* in which toner is stored and a toner conveyor portion 10*b* formed with toner discharge port 2.

Partitioning wall 4 is a plate-like part extended in the longitudinal direction of toner container 1 and is formed so as to leave a space between itself and top lid 1*a*. In other words, an opening between partitioning wall 4 and top lid 1*a* is formed so as to establish communication between toner reservoir 10*a* and toner conveyor portion 10*b*.

As shown in FIGS. 4 and 5, a square communication opening 4*a* that opens so as to establish communication between toner conveyor portion 10*b* and toner reservoir 10*a* is formed around toner conveying member 3 near toner discharge port 2. In the present embodiment, this communication opening 4*a* is formed by removing partitioning wall 4 near toner discharge port 2 (by cutting out partitioning wall 4, for example).

Accommodated above toner discharge port 2 inside toner conveyor portion 10*b* is toner conveying member 3.

This toner conveying member 3 includes, as shown in FIG. 4, a first rotary shaft 3*a*, a helical blade 3*b* and a discharge rotor 3*c*, and is driven by an unillustrated motor with gears. The motor is connected to a controller (not shown) of image forming apparatus 30. The rotational operation of first rotary shaft 3*a* is controller by this controller.

First rotary shaft 3*a* is a cylindrical element that is arranged with its axis extended in the longitudinal direction of toner container 1 and axially supported rotatably at both ends by the side walls of toner container 1.

Helical blade 3*b* is a blade that is helically formed around first rotary shaft 3*a*. This may be formed of, for example a screw auger, spiral coil or the like. As shown in FIG. 4, the end on the downstream side (on the left side in the drawing) with respect to the toner conveying direction of helical blade 3*b* is formed up to the vicinity of the peripheral edge, designated at 4*a*1, of communication opening 4*a*.

As shown in FIGS. 2, 4 and 5, discharge rotor 3*c* is given as square plate-like agitating blades, formed on a plane including the axis of first rotary shaft 3*a* and positioned so as to oppose toner discharge port 2.

Toner conveying member 3 is rotated about first rotary shaft 3*a* by drive force from an unillustrated motor so as to convey the toner stored inside toner conveyor portion 10*b* of toner container 1 from one end (the right side in FIG. 5) in the axial direction of toner conveying member 3 toward toner discharge port 2 and supply toner from toner discharge port 2 into developing vessel 11 of developing device 20.

Toner agitator 8 is accommodated inside toner reservoir 10*a*.

As shown in FIG. 2, toner agitator 8 includes a second rotary shaft 8*a*, a toner agitating plate 8*b* and a toner scooping blade 8*c*, and is driven by an unillustrated motor with gears. The motor is connected to a controller (not shown) of image forming apparatus 30 so that the rotational operation of second rotary shaft 8*a* is controlled by this controller.

As shown in FIG. 4, second rotary shaft 8*a* is a cylindrical element that is arranged with its axis extended in the longitudinal direction of toner container 1 and axially supported rotatably at both ends by the side walls of toner container 1.

Toner agitating plate 8*b* is a plate-like member that extends from second rotary shaft 8*a* radially outwards (in the directions perpendicular to the direction in which the axis extends (which will be referred to hereinbelow as the axial direction)) so that one half from the rotary shaft forms a phase difference of 180° from the other half.

As shown in FIG. 4, toner scooping blade 8*c* is a sheet-like member having a dimension in the longitudinal direction (the axial direction of second rotary shaft 8*a*) approximately equal to the longitudinal dimension of toner agitating plate 8*b*.

As shown in FIG. 2, toner scooping blade 8*c* is disposed so that its one longitudinal edge is integrally attached to toner agitating plate 8*b* while the other longitudinal edge can abut, or come into sliding contact with, the interior wall of toner container 1.

Toner scooping blade 8*c* preferably has a thickness of 0.5 mm to 2.0 mm, and is formed of a flexible member, preferably formed of polyethylene terephthalate (PET) resin or the like, though the material is not particularly limited.

The above-described configuration of toner scooping blade 8*c* makes toner scooping blade 8*c* ready to deform. As a result, toner scooping blade 8*c* moves sliding along the interior wall of toner container 1 as it is deforming (elastically deforming), so that it is possible to scoop up the toner more smoothly and convey the toner to toner conveyor portion 10*b*.

The toner held inside toner reservoir 10*a* of toner container 1 is agitated as toner agitator 8 rotates about second rotary shaft 8*a*, at the same time, the toner held inside toner reservoir 10*a* of toner container 1 is scooped up and conveyed to toner conveyor portion 10*b* as toner scooping blade 8*c* moves deforming and sliding along the interior wall of toner container 1.

As described above, since the interior space of toner container 1 is divided along the longitudinal direction by partitioning wall 4 into toner conveyor portion 10*b* and toner reservoir 10*a*, the weight of toner held in toner reservoir 10*a* will not act on the toner conveyed by toner conveying member 3. Accordingly, it is possible to alleviate stress acting on the toner being conveyed by toner conveying member 3, hence prevent degradation of the properties of the toner.

Further, in order to efficiently perform toner conveyance by toner agitator 8 and toner conveying member 3, the height of partitioning wall 4 provided between toner agitator 8 and toner conveying member 3 is preferably designed to be as high as the vertically highest point of toner conveying member 3 when toner cartridge 10 is mounted to image forming apparatus 30.

In this way, when the height of partitioning wall 4 is designed to be substantially equal to the vertical height point of toner conveying member 3, it is possible to prevent the toner that has been once conveyed, from returning from toner conveyor portion 10*b* to toner reservoir 10*a*. As a result, a suitable amount of toner can be kept around toner conveying member 3, hence it is possible to make toner conveying member 3 convey toner efficiently in a stable manner while reducing stress on the toner.

As shown in FIGS. 2 and 5, toner container 1 has an airtight cover (enclosing member) 5 that is formed in the portion opposing toner discharge port 2 located at the bottom of toner conveyor portion 10*b* so as to enclose the upper part of toner conveying member 3.

Airtight cover 5 has an inner peripheral surface 5*a* that encloses the periphery of toner conveying member 3 in cooperation with toner container 1 and an aftermentioned pressure relief valve 9. That is, a cylindrical tunnel-shaped space 10*b*1 (FIGS. 2, 6A and 6B) that is defined by toner container 1, aftermentioned pressure relief valve 9 and inner peripheral surface 5*a*, is formed over toner discharge port 2 in toner conveyor portion 10*b*.

Provision of tunnel-shaped space 10*b*1 makes air difficult to enter around toner discharge port 2 in toner conveyor portion 10*b*, it is possible to prevent occurrence of a toner-slide phenomenon (the phenomenon that toner around toner discharge port 2 becomes aerosol and abruptly flows down) triggered by vibrations etc. transferred to the cartridge.

Further, a pressure relief valve (pressure relieving portion) 9 is provided in toner conveyor portion 10*b* at a position opposing communication opening 4*a* so as to cover communication opening 4*a*, as shown in FIGS. 6A and 6B.

Pressure relief valve 9 is formed of a square sheet element made of an elastically deformable flexible sheet. This pressure relief valve 9 is fixed at its upper end 9*b* as a fixed end to airtight cover 5 located over communication opening 4*a* with an attachment screw 9*a* while the lower end, designated at 9*c* is left as a free end.

As shown in FIG. 6B, pressure relief valve 9 is formed to open the lower part of communication opening 9*a* by deforming lower end 9*c* toward the toner reservoir 10*a* side.

Next, the operation of supplying toner from toner 30 of the present embodiment will be described.

When toner is supplied from toner cartridge 10 to developing device 20, toner agitator 8 is rotated in the direction of arrow E as shown in FIG. 8 so as to agitate the toner inside toner reservoir 10*a* and scoop up toner by scooping blade 8*c* towards toner conveyor portion 10*b*.

At this time, toner scooping blade 8*c* rotates as it is deforming and sliding over the inner wall of toner reservoir 10*a* due to the flexibility of the material that forms the blade, whereby the toner on the downstream side with respect to the rotational direction, or the toner residing on the right side (close to developing device 20 in FIG. 2) in toner reservoir 10*a* and over the toner scooping blade 8*c* is supplied to toner conveyor portion 10*b* side.

Then, the toner supplied to the toner conveyor portion 10*b* side is conveyed toward toner discharge port 2 as shown in FIG. 5 by helical blade 3*b* as toner conveying member 3 rotates and supplied to developing device 20 through toner discharge port 2, as shown in FIG. 2.

At normal toner conveyance of toner conveying member 3, the toner conveyed by toner conveying member 3 and residing inside tunnel-shaped space 10*b*1 is not exposed to a high-pressure condition, hence the toner is conveyed from toner conveyor portion 10*b* (tunnel-shaped space 10*b*1) to toner discharge port 2 without pressure relive valve 9 deformed.

In contrast, when the toner conveyed by toner conveying member 3 is not conveyed smoothly around toner discharge port 2, toner is compressed and the pressure of the toner becomes higher around toner discharge port 2 in toner conveyor portion 10*b*. In the present embodiment, since the periphery of toner conveying member 3 in toner conveyor portion 10*b* of toner discharge port 2 is enclosed by airtight cover 5, the toner inside tunnel-shaped space becomes high in pressure.

As the pressure of the toner inside tunnel-shaped space 10*b*1 becomes higher, the lower end 9*c* of pressure relief valve 9 is flexed by the toner pressure as shown in FIG. 6B and deformed and pushed out to the toner reservoir 10*a* side. This deformation of pressure relief valve 9 partially opens communication opening 4*a*, so that part of toner inside tunnel-shaped space 10*b*1 flows into the toner reservoir 10*a* side. That is, it is possible to prevent the toner inside tunnel-shaped space 10*b*1 from becoming excessively high in pressure because toner moves from toner conveyor portion 10*b* to toner reservoir 10*a* through communication opening 4*a*.

As described heretofore, since toner cartridge 10 according to the present embodiment includes: airtight cover 5 that encloses the top of toner conveying member 3 in the vicinity of toner discharge port 2 in toner conveyor portion 10*b*; communication opening 4*a* for connecting toner conveyor portion 10*b* with toner reservoir 10*a*; and pressure relive valve 9 that opens and closes communication opening 4*a* in accordance with the pressure of the toner in the space enclosed by airtight cover 5, pressure relive valve 9 is released when the fluidity of the toner near toner discharge port 2 in toner conveyor portion 10*b* lowers and the toner is about to become higher in pressure and is going to be compressed, so that the toner escapes from the toner conveyor portion 10*b* side to the toner reservoir 10*a* side. Accordingly, it is possible to reduce the pressure of the toner around toner discharge port 2. As a result, it is possible to prevent toner from being compressed and clumping around toner discharge port 2 and prevent toner conveying member 3 from being locked.

In the above way, according to image forming apparatus 30 of the present embodiment, since it is possible with toner cartridge 10 to carry out stable toner supply to developing device 20, highly qualified images can be output in a stable manner.

Further, according to the present embodiment, since toner conveying member 3 includes discharge rotor 3*c* at the position opposing toner discharge port 2 so that discharge rotor 3*c* can be rotated about first rotary shaft 3*a*, the toner pressure can be readily transferred to pressure relief valve 9. As a result, it is possible to smoothly open communication opening 4*a* when the pressure of toner has increased.

Further, since pressure relief valve 9 is configured of a flexible sheet with its upper end 9*b* fixed to the top of communication opening 4*a* and its lower end 9*c* set free, the lower side of communication opening 4*a* is opened greater than the upper side as the flexible sheet is flexed. As a result, toner can readily move passing through communication opening 4*a* from toner conveyor portion 10*b* to toner reservoir 10*a*. Furthermore, this valve function can be realized with a simple structure.

Though the above embodiment was described taking an example in which the toner cartridge of the present technology is applied to image forming apparatus 30 shown in FIG. 1, as long as it is an image forming apparatus in which toner is supplied to a developing device using a toner cartridge, the technology can be developed to any other image forming apparatus and the like, not limited to the image forming apparatus and copier described above.

Having described heretofore, the present technology is not limited to the above embodiment, various changes can be made within the scope of the appended claims. That is, any embodied mode obtained by combination of technical means modified as appropriate without departing from the spirit and scope of the present technology should be included in the technical art of the present technology.

What is claimed is:

1. A toner cartridge comprising:

a toner reservoir for storing toner; and, a toner conveyor portion including a toner discharge port for discharging the toner from the toner reservoir to the outside and a toner conveying member for conveying the toner to the toner discharge port, characterized in that the toner conveyor portion includes, in the vicinity of the toner discharge port;

an enclosing member that encloses an upper part of the toner conveying member located over the toner discharge port;

a communication opening connecting between the toner conveyor portion and the toner reservoir; and, a pressure relieving portion for opening and closing the communication opening in accordance with a pressure of the toner enclosed by the enclosing member, the pressure relieving portion allowing toner in the toner conveying portions to pass through the communication opening and into the toner reservoir.

2. The toner cartridge according to claim 1, wherein the toner conveying member includes:

a rotary shaft; and a helical blade provided around the rotary shaft, and the end of the helical blade on the downstream side with respect to the toner conveying direction is formed up to the vicinity of the peripheral edge of the communication opening.

3. The toner cartridge according to claim 1, wherein the toner conveying member includes a plate-like discharge rotor provided on a plane that passes through the axis of the rotary shaft, and, the discharge rotor is arranged so as to oppose the toner discharge port.

4. The toner cartridge according to claim 1, wherein the pressure relieving portion is formed of an elastically deformable sheet member, and the sheet member is arranged so as to be able to close the communication opening and so that the end on the upper side of the communication opening is fixed while the end on the lower side of the communication opening is set free.

5. An image forming apparatus for forming an image with toner based on electrophotography, comprising:

a photoreceptor drum for forming an electrostatic latent image on the surface thereof;

a developing device for forming a toner image by supplying toner to the electrostatic latent image on the photoreceptor drum surface;

a toner cartridge for supplying toner to the developing device by means of a toner supply assembly;

a transfer device for transferring the toner image on the photoreceptor drum surface to a recording medium; and a fixing device for fixing the toner image on the recording medium, characterized in that the toner cartridge employs the toner cartridge defined in claim 1.

6. The toner cartridge according to claim 1, wherein the pressure relieving portion is configured to open the communication opening when a pressure of the toner enclosed by the enclosing member is greater than a threshold value so that toner can pass from the toner conveying portion, through the communication opening and into the toner reservoir.

7. The toner cartridge according to claim 1, further comprising a partitioning wall that separates the toner reservoir from the toner conveying portion, wherein the communication opening is located in the partitioning wall.

8. The toner cartridge according to claim 7, wherein the pressure relieving portion comprises an elastically deformable sheet member that is attached to a side of the partitioning wall facing the toner reservoir such that the elastically deformable sheet covers the communication opening.

9. The toner cartridge according to claim 8, wherein an upper portion of the elastically deformable sheet is affixed to a portion of the partitioning wall located over the communication opening, and wherein a lower portion of the elastically deformable sheet is free to move with respect to the partitioning wall.

10. The toner cartridge according to claim 8, wherein the elastically deformable sheet is configured to prevent toner in the toner reservoir from moving through the communication opening and into the toner conveying portion.

11. The toner cartridge according to claim 1, wherein the pressure relieving portion is configured to prevent toner in the toner reservoir from moving through the communication opening and into the toner conveying portion.

* * * * *